United States Patent [19]

Shuey

[11] 4,052,660

[45] Oct. 4, 1977

[54] DC SERIES VOLTAGE REGULATOR WITH GATING MEANS FOR OUTPUT TO REMAIN OFF UNTIL REGULATION LEVEL IS REACHED

[75] Inventor: Kenneth C. Shuey, Cridersville, Ohio

[73] Assignee: Westinghouse Electric Corporation, Pittsburgh, Pa.

[21] Appl. No.: 713,560

[22] Filed: Aug. 11, 1976

[51] Int. Cl.[2] ..... G05F 3/08

[52] U.S. Cl. ..... 323/19; 323/22 T

[58] Field of Search ..... 323/16, 19, 22 T, 22 Z

[56] References Cited

U.S. PATENT DOCUMENTS 3,968,421 7/1976 Marcade ..... 323/22 T

OTHER PUBLICATIONS

Davidson et al., "Bias Stabilizer for Amplifier", IBM TDB, vol. 14, No. 2, July 1971, p. 454.

*Primary Examiner*—A. D. Pellinen
*Attorney, Agent, or Firm*—G. H. Telfer

[57] ABSTRACT

A series voltage regulator for producing a regulated direct output voltage from a direct input voltage that is subject to variations, such as gradually increasing with time upon application of source voltage, with first and second transistors of opposite polarity where the collector emitter path of the first transistor is in series relation between the input and output terminals and the emitter-collector path of the second transistor is in series relation between the input terminal and the base electrode of the first transistor. A voltage limiter such as a zener diode is connected between the base of the second transistor and a common input-output terminal. As source voltage increases from zero, the first transistor remains off until it is supplied base drive, which occurs only after the second transistor becomes conductive. The second transistor will conduct when the input voltage exceeds the sum of the second transistor's base emitter voltage drop and the voltage drop of the zener diode. Saturation of the second transistor will cause the regulator to produce a steady output equal to the sum of the voltage drops of the zener diode and the base collector junction of the second transistor, minus the voltage drop of the base emitter junction of the first transistor.

2 Claims, 5 Drawing Figures

DC SERIES VOLTAGE REGULATOR WITH GATING MEANS FOR OUTPUT TO REMAIN OFF UNTIL REGULATION LEVEL IS REACHED

BACKGROUND OF THE INVENTION

This invention relates to electronic apparatus and particularly to transistorized voltage regulators.

Circuits are known that use a transistor for producing a regulated direct output voltage. A simple, yet representative, form of such a circuit is shown in FIG. 1, where a single transistor Q1 of NPN polarity has its collector connected through a resistor R1 to an input terminal and its emitter connected to an output terminal. The base of Q1 is connected through a resistor R2 to the input terminal and also through zener diode CR1 to a common line. The circuit contemplates a positive going voltage at the input terminal as compared with the common line. Assume the source voltage at the input terminal ramps up at a gradual rate, typically linearly, to a level that exceeds the desired output voltage regulation level.

FIG. 4 is a plot of direct voltage with time where line A shows the increasing source voltage, while dashed line B is the desired output voltage regulation level. As the source voltage increases from zero, the output voltage of the circuit of FIG. 1 will follow the DC input voltage until the regulation level is reached, as shown by line C of FIG. 4. The reason for this is that the transistor Q1 of FIG. 1 is supplied base drive continually, and continually produces an output following the rate of increase of the input up to the level at which it is limited by the voltage drop of the zener diode. Numerous variations of the basic circuit shown in FIG. 1 have been employed. Generally, these have to do with additional elements for maintaining the regulated voltage level more precisely and to provide current limiting protection for a load connected at the output terminal.

Such circuits as that of FIG. 1 and its variations which have the characteristic illustrated in line C of FIG. 4 are very useful in many applications. There are applications, however, where the provision of a voltage regulator producing output voltage at a gradually increasing rate in accordance with a ramped source is disadvantageous. FIG. 5 shows one such application. In FIG. 5 is shown a circuit for an electromechanical switching device for a circuit breaker where the mechanical breaker contacts 10 associated with a three-phase line are controlled to produce a change of state from on to off, or the reverse, by energization of a coil 12 associated with a movable core 13. The coil has a switching device 14, such as a transistor, connected with it which is controlled by a logic circuit 16, referred to in the art as a high threshold logic (HTL) circuit. This is a known form of logic circuit offering advantages by reason of high noise immunity and moderate power dissipation. For the HTL circuit to work effectively, it is necessary that the voltage supplied to it be one that has an abrupt change between a zero level and the regulated voltage level. If not, then the logic circuit can see less than its rated supply voltage, typically 15 volts for HTL, which can result in confusion of the logic states. The HTL circuit may receive inputs from a variety of sources, such as transducers that monitor various conditions appearing on the power buses. In order to guarantee the output states of the logic circuit, the supply voltage to it from the voltage regulator 18 should be substantially free of voltages at magnitudes intermediate between zero and the rated supply voltage. Therefore, for applications such as that of FIG. 5, the voltage regulator should not be one like that shown in FIG. 1, where the output of the regulator gradually increases from zero to the regulation level.

The apparatus schematically shown in FIG. 5 is that generally referred to as an electrical load control unit or ELCU, as used, for example, in aircraft electrical systems. It will be apparent that the conditions imposed upon the voltage regulator in this example may obtain in other cases where regulated voltage sources are required.

In the past, in order to achieve the required voltage regulation characteristic for applications such as FIG. 5, there have been used voltage regulators such as that illustrated in FIG. 2. Here, the components Q1, CR1, R1 and R2 are connected in the same manner as the correspondingly numbered components of the circuit of FIG. 1. However, in addition, this circuit utilizes transistors Q2 and Q3, of the same polarity as Q1, and associated resistors R3, R4, and R5 and zener diode CR2, connected in the manner shown to serve as a clamping circuit to clamp the voltage across the zener diode CR1 to zero until the input voltage reaches the desired level which is set by the voltage drop of zener diode CR2 and the base-emitter voltage of transistor Q3. At this voltage level, the clamp is effectively removed and the regulator operates normally at the regulation level. The additional components of FIG. 2 alter the performance of the circuit as compared with that of FIG. 1 so that now the output characteristic is as shown by curve D of FIG. 4 such that the output voltage is kept at the zero level until, or almost until, the source voltage reaches the regulation level. At this point, the output voltage makes a marked change in a very brief time from zero up to the regulation level. This is the desirable characteristic of a voltage regulator for applications such as that shown in FIG. 5 and is the type of characteristic that is sought by the voltage regulator of the present invention. However, the circuit of FIG. 2 is made complex and expensive by the additional elements Q2, Q3, R3, R4, R5 and CR2 so that it is therefore desired that essentially the same regulation characteristics as is exhibited by the circuit of FIG. 2 be provided in a circuit of greater simplicity and economy, and this is the principal object of the present invention.

SUMMARY OF THE INVENTION

In accordance with the present invention, a series voltage regulator is provided for producing a regulated direct output voltage from a direct input voltage that is subject to variations, such as gradually increasing with time upon application of source voltage with an output that remains essentially zero until the desired regulation level is reached. The circuit includes first and second transistors of opposite polarity where the collector-emitter path of the first transistor is in series relation between the input and output terminals and the emitter-collector path of the second transistor is in series relation between the input terminal and the base electrode of the first transistor. A voltage limiter such as a zener diode is connected between the base of the second transistor and a common input-output terminal. As source voltage increases from zero, the first transistor remains off until it is supplied base drive, which occurs only after the second transistor becomes conductive. The second transistor will conduct when the input voltage exceeds the sum of the second transistor's base-emitter voltage drop and the voltage drop of the zener diode. Saturation of the second transistor will cause the regulator to produce a steady output equal to the sum of the voltage drops of the zener diode and the base collector junction of the second transistor, minus the voltage drop of the base-emitter junction of the first transistor.

Circuits of the present invention require only one additional transistor and one additional resistor as compared to the circuit of FIG. 1 while achieving a voltage regulation characteristic equal to that of the more complex circuit of FIG. 2 and suitable for the purposes discussed in connection with FIG. 5. The circuit in accordance with this invention may, however, be applied in other applications where a gated voltage source is required.

DESCRIPTION OF THE PREFERRED EMBODIMENT

Figure 3:
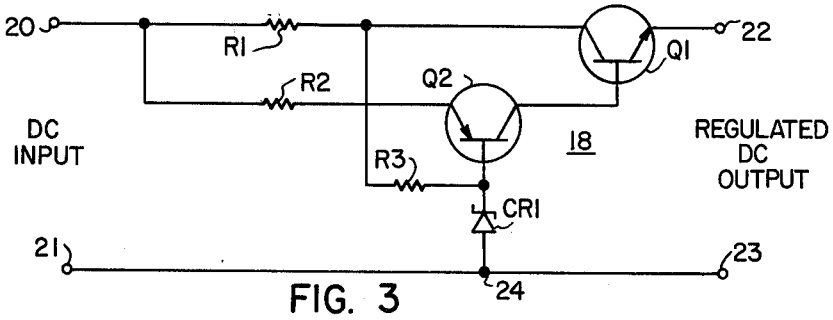
FIG. 3 is a circuit schematic of a DC series voltage regulator in accordance with one embodiment of the present invention for operation in a gated manner.
Figure 5:
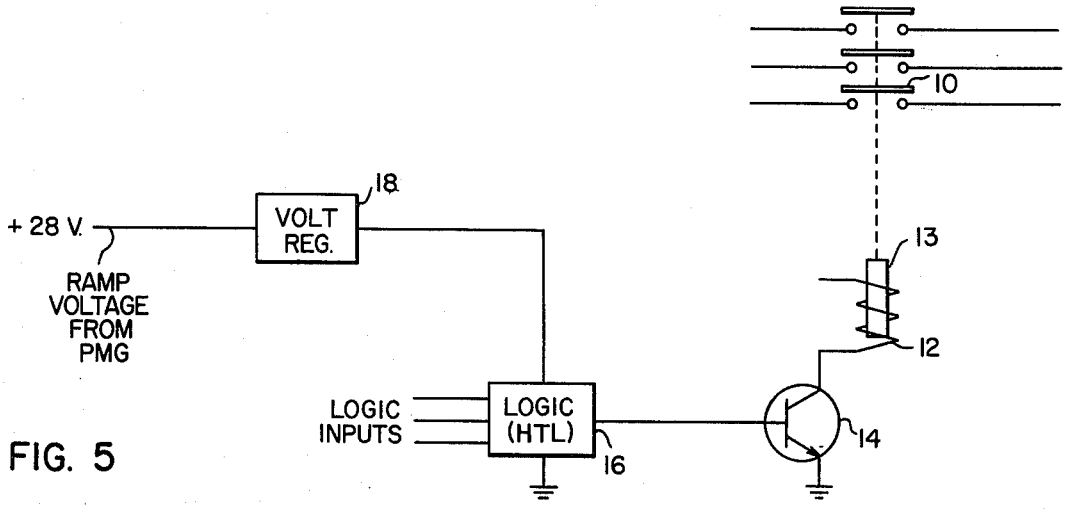

Referring to FIG. 3, a direct current series voltage regulator in accordance with the present invention is shown connected between first and second input terminals 20 and 21 and first and second output terminals 22 and 23 where the second input and second output terminals are connected to a common point 24. The input terminals are for connection to a source of direct voltage which is characterized by ramping from a zero level up to some positive level, such as +28 volts DC, which may be obtained from a permanent magnet generator. The output terminals are for connection to a load or utilization device which may be an HTL logic circuit, as illustrated in FIG. 5.

The circuit of FIG. 3 includes a first bipolar transistor Q1 of a first polarity, NPN in this example, having base, emitter and collector electrodes with the emitter and collector electrodes connected in series relation between the input and output terminals. The collector is connected to the input through resistor R1, which serves as a limiter to reduce the dissipation in Q1, and the emitter is connected to the output. A second bipolar transistor of a second polarity, PNP in this example, has base, emitter and collector electrodes with the emitter and collector electrodes connected in series relation between the input terminal and the base of Q1. As shown, the emitter of Q2 is connected through resistor R2, which has appreciably greater magnitude than resistor R1, to the input terminal and the collector of Q2 is connected to the base of Q1. Additionally, a resistor R3 of appreciably greater magnitude than either of resistors R1 and R2 is connected from the collector of Q1 to the base of Q2. A zener diode CR1 is shown in this example as a means for voltage limiting connected between the common point 24 and the base electrode of Q2 and is poled in a direction shown in opposition to the source voltage which is contemplated to be positive going at the input terminal 20. Other voltage limiting means may be employed such as a metal oxide varistor.

By way of further example, the following table presents a list of suitable components for use in the circuit of FIG. 3.

| | |
|---|---|
| Q1 | 2N3441 |
| Q2 | 2N2904A |
| CR1 | 15 v. |
| R1 | 50 ohms |
| R2 | 1,000 ohms |
| R3 | 100,000 ohms |

In operation, the transistor Q1, which may be regarded as the main transistor producing the regulated output, is gated by Q2 so that transistor Q1 cannot produce an output until the source level is up to the desired level of the regulated output. Q1 remains off until current starts to flow into its base. Base current into Q1 will not begin to flow until Q2 is turned on and this will occur only when the source voltage exceeds the sum of the voltage drop across the base-emitter junction of Q2 and the zener diode CR1. Therefore, the zener diode CR1 sets the regulation level since the emitter to base voltage drop of Q2 is across a forward biased junction of low voltage drop. The current that then starts to flow through Q2 starts base current flow into Q1 aided by the positive feedback of R3, which will drive Q1 on hard so that the output terminal rapidly reaches the regulation voltage level. With Q2 in saturation, the regulator works normally, that is, similar to the manner of FIG. 1, despite the source voltage exceeding the desired regulation level because the output is restricted to a voltage that is equal to the zener diode voltage minus the base emitter voltages of Q1 plus the base-collector voltage of Q2. In this manner, the output can be maintained at the desired regulation level set by the zener diode.

The resistor R3 is optional, but is preferred in order to decrease the band of input voltage required to switch the regulated output from zero to the desired level. When load current starts to flow through R1, the voltage at the collector of Q1 drops slightly. This voltage decrease is coupled to the base of Q2, because of the presence of the branch containing R3, which adds a slight amount of positive feedback to the operation of the transistors and improves the snap action that turns on the regulator.

Figure 1:
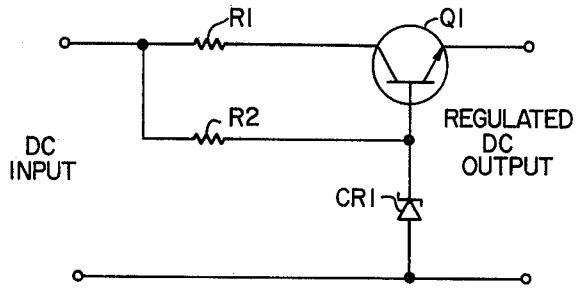
FIG. 1 PRIOR ART
FIG. 1 is a circuit schematic of a DC series voltage regulator in accordance with the prior art which operates in an ungated manner.
Figure 4:
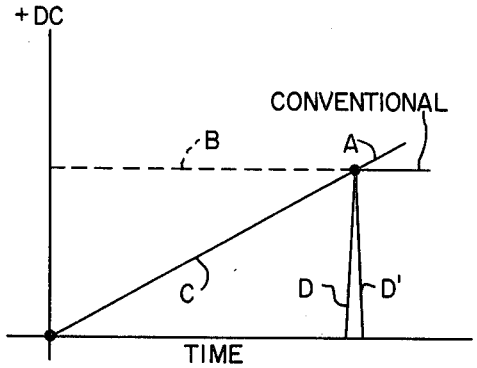
FIG. 4 is a set of curves of voltage against time illustrating the performance of the circuits of FIGS. 1, 2 and 3; and, FIG. 5 is a circuit schematic of an electrical load control unit wherein the application of the present invention is advantageous.
Figure 2:
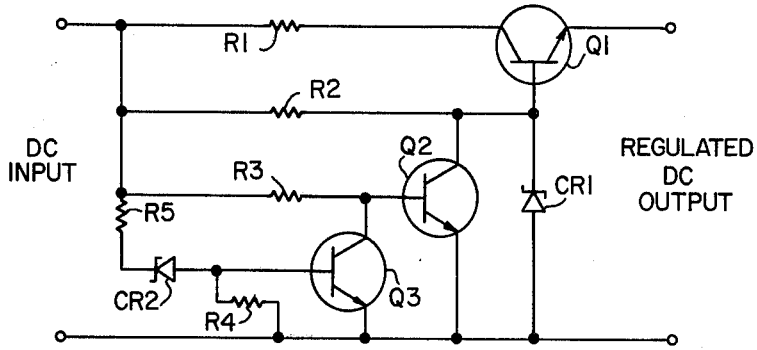
FIG. 2 PRIOR ART
FIG. 2 is a circuit schematic of a DC series voltage regulator in accordance with the prior art that operates in a gated manner.

The data in Table I below shows a comparison of conventional regulators, in accordance with FIG. 1, with the circuit of FIG. 3, in accordance with the present invention, and demonstrates how the output is maintained at zero level up to the input level 15 volts, at which time it goes through an abrupt transition with the output being maintained essentially constant thereafter. The characteristic exhibited by the circuit in accordance with this invention is essentially like that of curve D of FIG. 4 including a portion with hysteresis D' to avoid oscillation between the zero and regulation levels. For all practical purposes, performance is equivalent to the characteristic as exhibited by the circuit of FIG. 2 while achieving that characteristic in a simple manner with fewer components and less expense. The simplicity and reduction in components not only contributes to the economy of the circuit but also contributes to the reliability of performance of the circuit.

It will be apparent that various changes and modifications may be made in accordance with the knowledge of the art while practicing the present invention. For example, if it is the case that the input voltage is negative-going in relation to the common terminal, then the polarities of the various transistors may be reversed and the polarity of the zener diode or other current limiter reversed, resulting in a regulated output at a negative level of voltage.

TABLE I

| D.C. Voltage Input (v.) | Regulated D.C. Voltage Output (volts) | |
|---|---|---|
| | Circuit of FIG. 1 | Circuit of FIG. 3 |
| 0 | 0 | 0 |
| 5 | 3.64 | 0 |
| 10 | 8.45 | 0 |
| 15 | 13.3 | 0 |
| 15.8 | 14.25 | 5.3 |
| 16.1 | 14.4 | 15.0 |
| 20 | 14.7 | 15.5 |
| 25 | 14.9 | 15.8 |
| 30 | 15.3 | 16.0 |

I claim:

1. A series voltage regulator for producing a regulated direct output voltage from a direct input voltage that is subject to variation, said regulator comprising:

first and second input terminals for direct voltage application thereto;

first and second output terminals for supply of a regulated direct voltage thereat in response to voltage applied to said input terminals, said second input and second output terminals being directly connected to a common point;

a first transistor of a first polarity having base, emitter and collector electrodes with said emitter and collector electrodes connected in series relation between said first input and first output terminals;

a second transistor of a second polarity having base, emitter and collector electrodes with said emitter and collector electrodes connected in series relation between said first input terminal and said base electrode of said first transistor;

means for voltage limiting connected between said common point and said base electrode of said second transistor;

first resistance means connected between said first input terminal and said collector of said first transistor;

second resistance means connected between said first input terminal and said emitter of said second transistor; and third resistance means connected between said collector of said first transistor and said base of said second transistor.

2. A voltage regulator in accordance with claim 1 wherein: said third resistance means is larger than said second resistance means which is larger than said first resistance means.

* * * * *